US008690003B2

(12) United States Patent
Gaudron

(10) Patent No.: US 8,690,003 B2
(45) Date of Patent: Apr. 8, 2014

(54) GAS CARTRIDGE

(75) Inventor: Paul Gaudron, Stratford, CT (US)

(73) Assignee: Black & Decker Inc., Newark, DE (US)

( * ) Notice: Subject to any disclaimer, the term of this patent is extended or adjusted under 35 U.S.C. 154(b) by 535 days.

(21) Appl. No.: 12/880,719

(22) Filed: Sep. 13, 2010

(65) Prior Publication Data

US 2012/0060717 A1 Mar. 15, 2012

(51) Int. Cl.
*F17C 1/02* (2006.01)

(52) U.S. Cl.
USPC ..... 220/586; 102/531; 29/446; 222/3; 222/92

(58) Field of Classification Search
USPC ..... 222/3, 92; 29/446; 102/531; 220/586
See application file for complete search history.

(56) References Cited

U.S. PATENT DOCUMENTS 5,265,765 A 11/1993 Maier
5,727,492 A * 3/1998 Cuneo et al. ..... 114/74 A
2005/0008908 A1 1/2005 Kaye et al.
2007/0181596 A1 8/2007 Murayama et al.
2007/0187426 A1* 8/2007 Murayama et al. ..... 222/3
2007/0295727 A1 12/2007 Murayama et al.

FOREIGN PATENT DOCUMENTS

DE 20200906 U1 6/2002
FR 2820127 7/1975

OTHER PUBLICATIONS

International Search Report and Written Opinion filed Sep. 13, 2011, Mailed Mar. 28, 2012; 11 pages.

* cited by examiner

*Primary Examiner* — Anthony Stashick
*Assistant Examiner* — Elizabeth Volz
(74) *Attorney, Agent, or Firm* — Cantor Colburn LLP

(57) ABSTRACT

A method of forming an inner can of a gas cartridge including securing inner can material and pre-stressing the material such that flexion thereof during gas cartridge use is distributed.

7 Claims, 4 Drawing Sheets

GAS CARTRIDGE

BACKGROUND OF THE INVENTION

The subject matter disclosed herein relates to a gas cartridge.

Typically, a setting tool for striking a fastener includes a gas cartridge provided with an outer vessel (outer can), a gas charge vessel (inner bag) and an inner space formed between the two vessels. Liquefied fuel inside the gas charge vessel is ejected when a valve is opened by a combination of the effects of exposing the liquefied fuel to atmospheric conditions and a compressing force applied thereto by compression gas at high pressure, which is charged into the inner space.

The outer vessel is generally rigid and provides support to the gas charge vessel, which is operationally disposed in an interior of the outer vessel. The gas charge vessel includes an opening portion that is opened by the valve and other portions that extend from the opening portion along the length of the outer vessel. Those other portions are formed of relatively thin aluminum or similar materials and are made to be easily deformable as the liquefied fuel is ejected.

A result of the gas charge vessel being formed of such thinly formed materials is that, when the gas charge vessel is deformed, the deformation proceeds freely and often non-uniformly. This non-uniform deformation can lead to extreme deformation at particular sections of the gas charge vessel and relatively little deformation at others. For example, the opening portion of the gas charge vessel may experience minor deformation whereas the central portions of the gas charge vessel may be nearly entirely crushed. In such a case, a wrinkle or a fold in the gas charge vessel material may be formed and eventually may lead to a crack or a pin hole being produced.

When a crack or a pin hole is produced at the gas charge vessel, the compression gas is permitted to enter the gas charge vessel and its pressure is reduced. Similarly, the liquefied fuel may leak from the gas charge vessel. In each case, the gas charge vessel may be insufficiently compressed and the liquefied fuel may be undesirably mixed with the compression gas or lost from the gas charge vessel. When the valve is subsequently opened, the entire quantity of the liquefied fuel may not be ejected. This represents a degraded operation of the setting tool and may constitute an economic loss.

BRIEF DESCRIPTION OF THE INVENTION

According to an aspect of the invention, a method of forming an inner can of a gas cartridge is provided and includes securing inner can material and pre-stressing the material such that flexion thereof during gas cartridge use is distributed.

According to another aspect of the invention, a gas cartridge is provided and includes an inner can, which is charged with fluid that is selectively ejectable toward a gas cartridge exterior, and which includes inner can material that is deformable as fluid ejection and thermal cycling of the fluid proceed and a flexion distribution feature to distribute flexion of the inner can material associated with deformation thereof among inner can sections.

According to another aspect of the invention, a gas cartridge is provided and includes an outer can, a cap, including a selectively actuatable valve, to enclose an interior of the outer can, an inner can disposed within the outer can interior, which is charged with fluid ejectable toward a gas cartridge exterior upon selective actuation of the valve, the inner can being deformable as fluid ejection and thermal cycling of the fluid proceed and a flexion distribution feature to distribute flexion associated with inner can deformation among inner can sections According to yet another aspect of the invention, a gas cartridge is provided and includes an outer can, a cap, including a selectively actuatable valve, to enclose an interior of the outer can and an inner can, which is charged with fluid, and which is disposed within the outer can interior to define a space charged with compression gas to encourage ejection of the fluid from the inner can toward a gas cartridge exterior upon selective actuation of the valve, the inner can including inner can material that is deformable as fluid ejection and thermal cycling of the fluid proceed with flexion associated with the deformation being distributed among multiple inner can sections.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
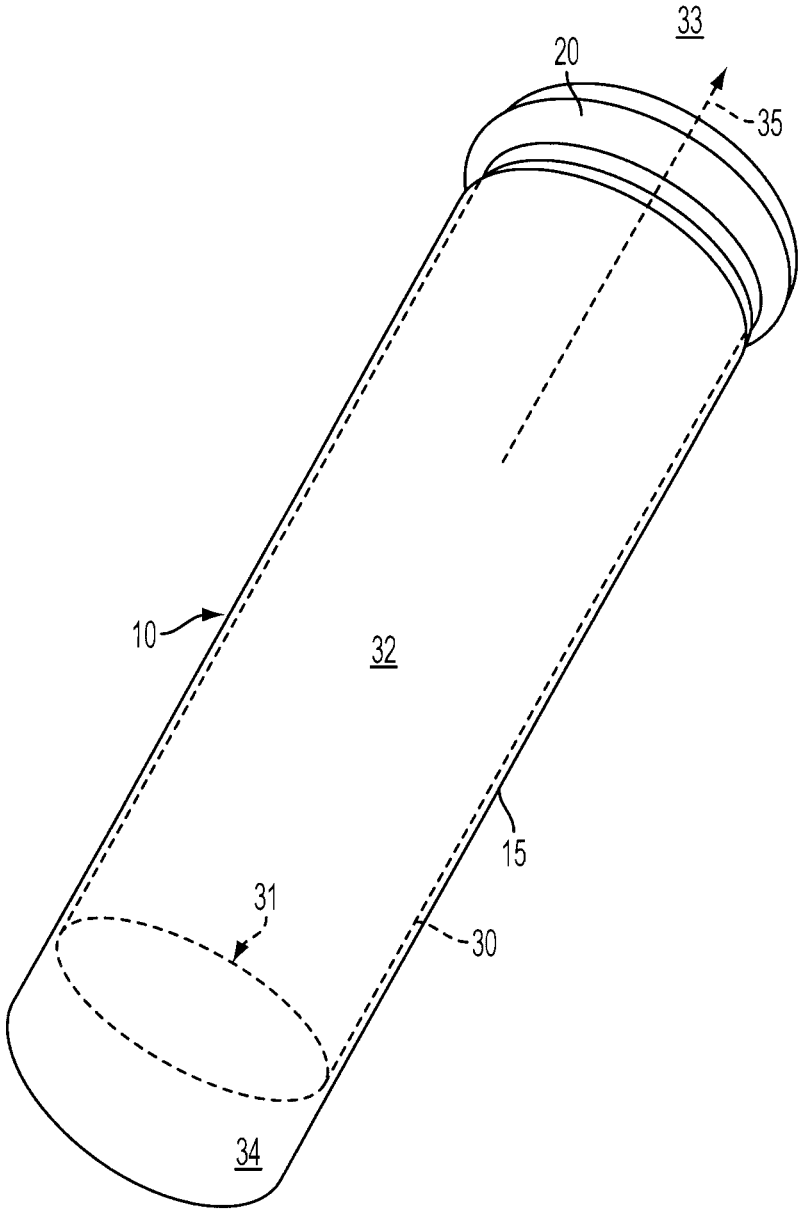
FIG. 1 is a perspective view of a gas cartridge.
Figure 2:
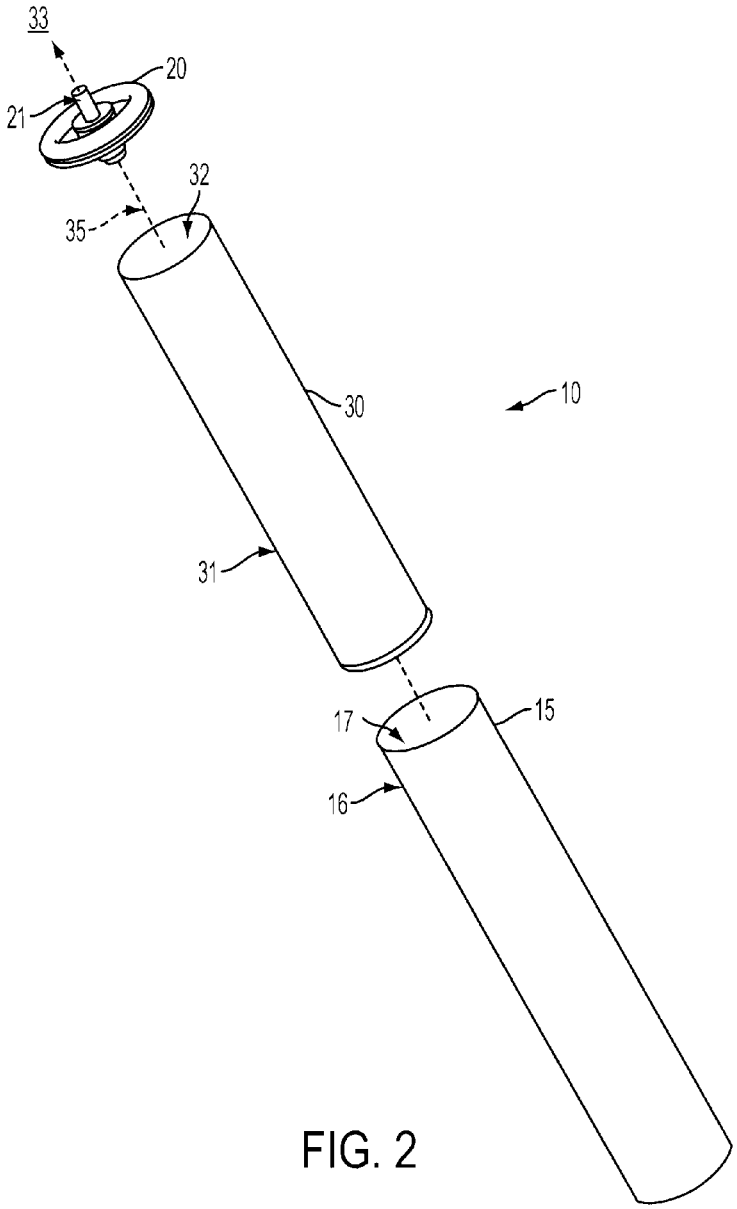
FIG. 2 is a disassembled perspective view of the gas cartridge of FIG. 1.

With reference to FIGS. 1 and 2, a gas cartridge 10 for use with, e.g., a setting tool, is provided and includes an outer can 15 having a peripheral wall 16 that is formed to define an outer can interior 17 and a cap 20. The cap 20 includes a selectively actuatable valve 21 and is attachable to a normally open end of the outer can 15 to enclose the outer can interior 17, the other end of the outer can 15 being capped or otherwise closed as well.

The gas cartridge 10 further includes an inner can 30, which is formed of inner can material 31 that is shaped to define an inner can interior 32. The inner can interior 32 may be charged with fluid, such as liquefied fuel, gas or similar fluids. Where the fluid is liquefied fuel, the liquefied fuel may, in some cases, be selected so that it vaporizes upon exposure to atmospheric conditions such that it can be ejected at high speed and/or high pressure. In this way, the gas cartridge 10 may be employed as a component of a setting tool in which the liquefied fuel vapor is able to be ejected for use with a targeted fastening element.

The inner can 30 may be disposed within the outer can interior 17 and supported by at least the cap 20 and, in some but not all cases, the peripheral wall 16 or structures coupled thereto. With the inner can 30 supported by the cap 20, the selectively actuatable valve 21 may define a pathway 35 extending from the inner can interior 32 to a gas cartridge exterior 33 (i.e., proximate to a targeted fastening element) when the selectively actuatable valve 21 is actuated and thereby opened.

Further, with the inner can 30 disposed within the outer can interior 17, the inner can 30 defines a space 34 between an exterior surface of the inner can material 31 and an interior surface of the peripheral wall 16. The space 34 may be charged with compression gas that exerts pressure on the inner can 30 that compresses the inner can 30 and encourages ejection of the fluid from the inner can interior 32 toward the gas cartridge exterior 33 upon the selective actuation of the selectively actuatable valve 21. Thus, if the pressure of the compression gas is high enough, it may not be necessary for the liquefied fuel to be vaporized upon exposure to atmospheric conditions since the pressure of the compression gas may be sufficient to eject the fluid from the inner can interior 32 at high enough velocity to accomplish a given application.

The inner can material 31 is relatively thin walled and made of, e.g., aluminum, tin, a similar metallic material or an alloy thereof, such that the inner can 30 is relatively easily deformed by the compression gas charged into the space 34 as fluid ejection from the inner can interior 32 proceeds and/or as thermal cycling of the fluid or the compression gas proceeds. In accordance with aspects of the invention, flexion of the inner can material 31, which is associated with the deformation of the inner can 30, is distributed among multiple sections of the inner can 30 by a flexion distribution feature as described below.

Figure 3A:
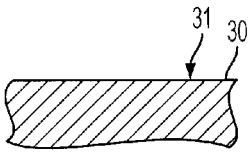
FIGS. 3A, 3B and 3C illustrate flexion of inner can material.
Figure 3B:
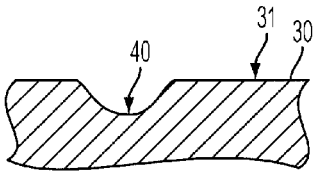
Figure 3C:
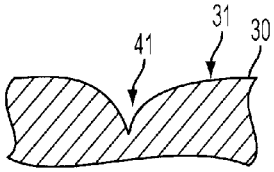

With reference to FIGS. 3A, 3B and 3C, flexion of the inner can material 31 occurs as a volume of the fluid charged in the inner can interior 32 decreases. As shown in FIG. 3A, this initial level may represent a case in which the volume of the inner can interior 34 is entirely filled with fluid such that the inner can material 31 is in tension. Upon a decrease in the volume of the fluid, as shown in FIG. 3B, the inner can material 31 is deformed and exhibits a dent or recess 40 caused. As shown in FIG. 3C, as the volume continues to decrease, a possibility exists that the resulting continued deformation will cause the recess 40 to eventually form a fold 41, which may lead to generation of a pinhole in the inner can 30 that will inhibit full ejection of the fluid and a corresponding product failure or economic loss.

With the flexion of the inner can material 31, which is associated with the deformation of the inner can 30, being distributed among multiple inner can sections, however, the eventual formation of such folds 41 may be avoided or substantially reduced. Also, as described below, this distribution of the flexion of the inner can material 31 may be dependent or independent of support providable by the outer can 15. That is, with reference to FIG. 4, the flexion of the inner can material 31 may be distributed among the multiple sections of the inner can 30 in accordance with the inner can 30 and/or the inner can material 31 being formed with flexion distributive structures.

Figure 4:
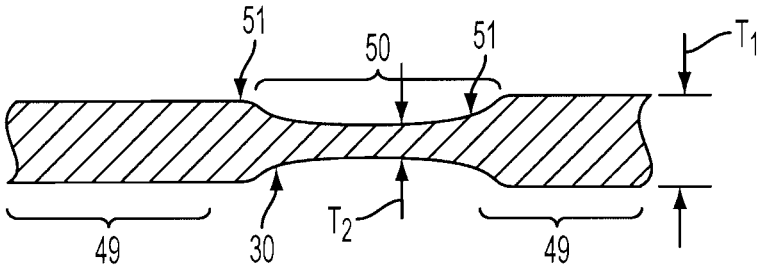
FIG. 4 is a schematic sectional view of inner can material according to embodiments.

As shown in FIG. 4, the flexion distribution feature may be provided by the inner can material 31 having differing thicknesses at various locations. For example, the inner can material 31 may be formed to have a first thickness, $T_1$, at first ones 49 of the multiple sections and a second thickness, $T_2$, which is for example thinner than the first thickness, $T_1$, at second ones 50 of the multiple sections. As such, the inner can 30 has throat sections 51 at borders between the first and second ones 49, 50 of the multiple sections that may serve as local stress points. The inner can 30 may be formed such that these local stress points are distributed at various locations of the inner can 30 such that, as inner can 30 deformation proceeds, the flexion of the inner can material 31 can be distributed to these local stress points as opposed to single locations where a fold 41 and/or an eventual pinhole may form.

Figure 5:
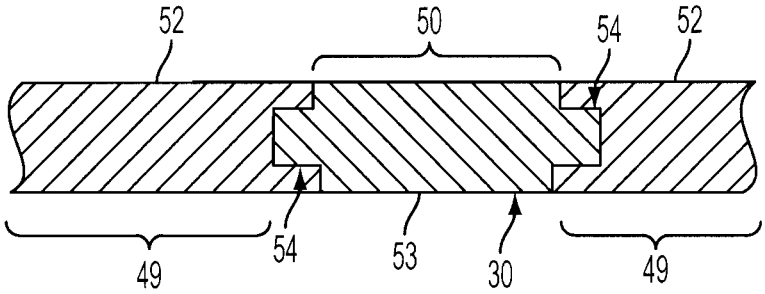
FIG. 5 is a schematic sectional view of various inner can materials according to embodiments.

As shown in FIG. 5, the flexion distribution feature may be provided by the inner can material 31 including various materials having different mechanical properties at various locations. For example, the inner can material 31 may include at the first ones 49 of the multiple sections a first material 52 and, at the second ones 50 of the multiple locations, a second material 53, which has at least one mechanical property that is different from that of the first material 52. For example, the second material 53 may mate with the first material 52 at sealing sections 54 and be more compliant than the first material 52.

Figure 6:
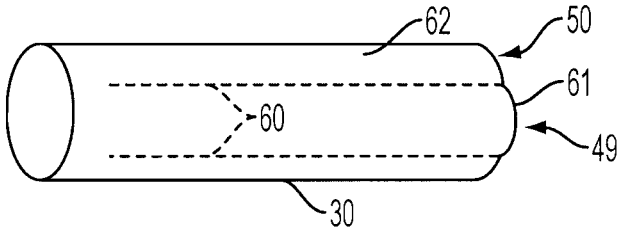
FIG. 6 is a side view of an inner can according to embodiments.

As shown in FIG. 6, the flexion distribution feature may be provided by the inner can 30 being formed with seams 60 that delimit borders of exemplary first and second portions 61, 62 at first and second ones 49, 50 of the multiple sections, respectively. These borders are formed such that the inner can 30, when fully charged with fluid, has a shape that may be regular or irregular. That is, in the example of FIG. 6, first and second portions 61 and 62 are substantially tubular and extend laterally in different directions. In this way, as deformation of the inner can 30 or thermal cycling proceeds, the first and second portions 61 and 62 will tend to deform in different directions such that developing stresses can be distributed in a similar manner as described above. It is understood that the example of FIG. 6 is not limiting and that other shapes both regular and irregular are possible.

The flexion distribution feature may be provided by the inner can 30 further including skeletal supports that are disposed at the inner can interior and/or exterior. In both cases, the skeletal supports may be formed to support the inner can 30 as deformation of the inner can 30 proceeds. The skeletal supports may each include elastic elements and/or may be coupled to the outer can 15 via coupling elements to further increase support of the inner can 30. The skeletal supports may also be movable relative to the cap 20 as the fluid ejection and the thermal cycling proceed.

In accordance with further embodiments of the invention, it is understood that the examples shown in FIGS. 4-6 are non-limiting and that other formations of the inner can 30 and types of inner can material 31 are possible. It is further understood that the various embodiments described herein and made possible by similar embodiments may be combined with one another.

Figure 7:
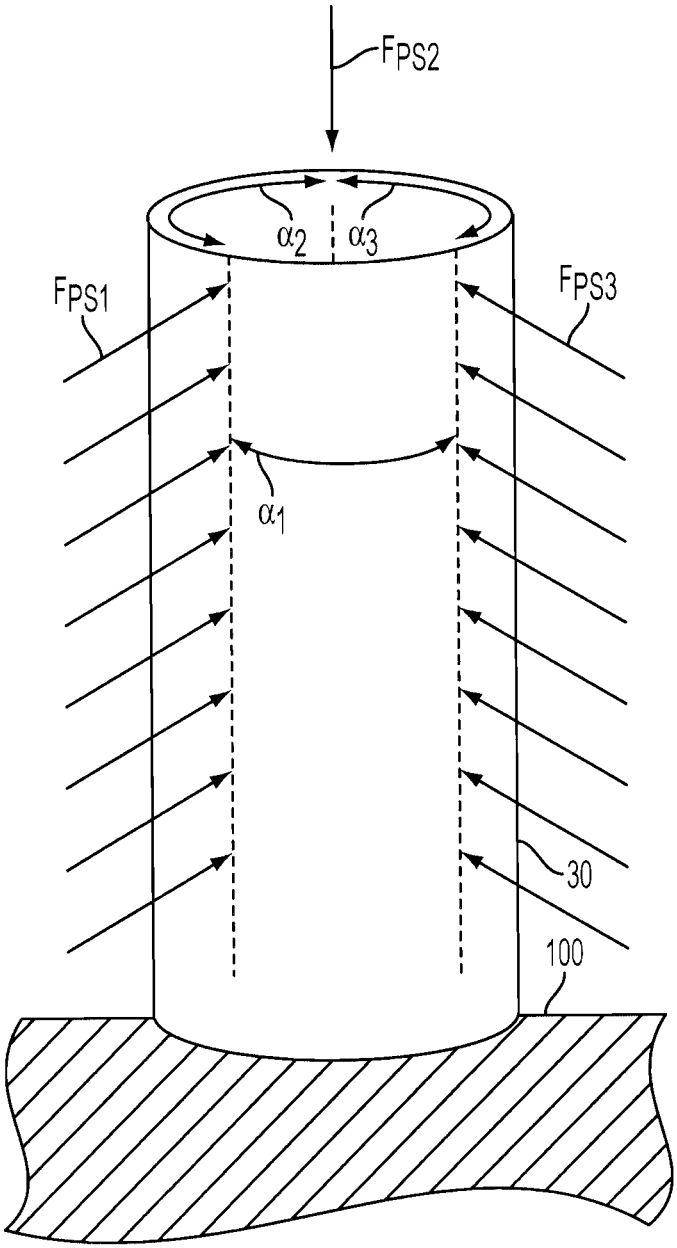
FIG. 7 is a schematic diagram of a method of forming an inner can of a gas cartridge.

With reference to FIG. 7 and, in accordance with further aspects, a method of forming the inner can 30 of the gas cartridge 10 is provided and includes securing the material to be formed into the inner can 30 in, for example, a holder 100 and pre-stressing the material at for example multiple locations such that flexion thereof during gas cartridge 10 use is distributed among multiple inner can sections associated with the exemplary multiple locations. Prior to the pre-stressing operation or following the per-stressing, the material may be formed into a substantially cylindrical shape, as shown in FIG. 2. That is, the pre-stressing may occur with the material already formed into the inner can 30 shape or prior to such shaping. As an example, the material may be pre-stressed while in sheet form or only a partial cylindrical form or after being formed into an otherwise completed inner can.

The multiple locations may extend linearly or substantially linearly along a longitudinal axis of the substantially cylindrical shape whether the pre-stressing occurs before or after the forming of the inner can 30 material into the substantially cylindrical shape. As such, the flexion distributed among the multiple inner can sections associated with the multiple locations will tend to occur along or in parallel with these longitudinally extending lines, which may be uniformly or non-uniformly circumferentially distributed ($\alpha_1=\alpha_2=\alpha_3$ or $\alpha_1\neq\alpha_2\neq\alpha_3$) and parallel with or transverse from one another.

The pre-stressing may be achieved by the application of pressure to the inner can 30 material at the multiple locations and/or the placing of the material in tension at the multiple locations. For example, as shown in FIG. 7, pressurizing forces $F_{PS1-3}$, which may be substantially equal or non-equal, can be applied to the inner can 30 material at the multiple locations before or after formation of the inner can 30 material into the substantially cylindrical shape.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method of forming an inner can of a gas cartridge, comprising:

securing inner can material;

forming the inner can material into a substantially cylindrical shape; and pre-stressing the inner can material such that flexion thereof during gas cartridge use is distributed, wherein the pre-stressing is performed at multiple locations, each of which extends along a longitudinal axis of the substantially cylindrical shape.

2. The method according to claim 1, wherein the securing comprises securing the inner can material in a holder.

3. The method according to claim 1, wherein the pre-stressing comprises applying pressure to the inner can material.

4. The method according to claim 1, wherein the pre-stressing comprises placing the inner can material in tension.

5. A method of forming an inner can of a gas cartridge, comprising:

securing inner can material; and pre-stressing the inner can material such that flexion thereof during gas cartridge use is distributed, wherein the pre-stressing comprises thinning the inner can material at first ones of the inner can sections to form throat sections at borders between the first ones of the inner can sections and second ones of the inner can sections.

6. A method of forming an inner can of a gas cartridge, comprising:

securing inner can material; and pre-stressing the inner can material such that flexion thereof during gas use is distributed, wherein the pre-stressing comprises providing the inner can material with various materials having different mechanical properties at various locations such that a second material overlappingly mates with a first material at borders between the various locations.

7. A method of forming an inner can of a gas cartridge, comprising:

securing inner can material; and pre-stressing the inner can material such that flexion thereof during gas cartridge use is distributed, wherein the pre-stressing comprises forming longitudinal seams to delimit correspondingly longitudinal borders between first and second inner can sections whereby the seams constrain inner can deformation such that the first and second inner can sections deform in different directions.

* * * * *